US006916769B2

(12) United States Patent
McRitchie et al.

(10) Patent No.: US 6,916,769 B2
(45) Date of Patent: Jul. 12, 2005

(54) FABRIC TREATMENT COMPOSITION

(75) Inventors: Allan Campbell McRitchie, Whitley Bay (GB); Michael Green, Kenton (GB); Jonathan Richard Clare, Jesmond (GB)

(73) Assignee: The Procter & Gamble Company, Cincinnati, OH (US)

( * ) Notice: Subject to any disclaimer, the term of this patent is extended or adjusted under 35 U.S.C. 154(b) by 219 days.

(21) Appl. No.: 10/308,509

(22) Filed: Dec. 3, 2002

(65) Prior Publication Data

US 2003/0153473 A1 Aug. 14, 2003

(51) Int. Cl.[7] ..... C11D 3/50
(52) U.S. Cl. ..... 510/101
(58) Field of Search ..... 510/101, 441, 510/452

(56) References Cited

U.S. PATENT DOCUMENTS

| | | | | | |
|---|---|---|---|---|---|
| 4,853,369 | A | * | 8/1989 | Mookherjee et al. | 512/25 |
| 5,188,753 | A | | 2/1993 | Schmidt et al. | |
| 5,270,379 | A | * | 12/1993 | McAndrew et al. | 524/555 |
| 5,360,568 | A | | 11/1994 | Madison et al. | |
| 5,360,569 | A | | 11/1994 | Madison et al. | |
| 5,370,826 | A | | 12/1994 | Madison et al. | |
| 5,500,137 | A | | 3/1996 | Bacon et al. | |
| 5,500,138 | A | | 3/1996 | Bacon et al. | |
| 5,500,154 | A | | 3/1996 | Bacon et al. | |
| 5,540,853 | A | | 7/1996 | Trinh et al. | |
| 5,652,206 | A | | 7/1997 | Bacon et al. | |
| 5,668,094 | A | | 9/1997 | Bacon et al. | |
| 5,780,404 | A | | 7/1998 | Bacon et al. | |
| 5,833,999 | A | | 11/1998 | Trinh et al. | |
| 5,849,310 | A | | 12/1998 | Trinh et al. | |
| 6,001,789 | A | | 12/1999 | Trinh et al. | |
| 6,086,903 | A | | 7/2000 | Trinh et al. | |
| 6,103,678 | A | | 8/2000 | Masschelein et al. | |
| 6,143,707 | A | | 11/2000 | Trinh et al. | |
| 6,180,119 | B1 | * | 1/2001 | Boussouira et al. | 424/401 |
| 6,194,362 | B1 | | 2/2001 | Trinh et al. | |
| 6,413,920 | B1 | | 7/2002 | Bettiol et al. | |
| 6,451,751 | B1 | | 9/2002 | Busch et al. | |
| 6,491,728 | B2 | | 12/2002 | Bacon et al. | |
| 6,509,308 | B1 | | 1/2003 | Buzzaccarini et al. | |
| 6,511,948 | B1 | * | 1/2003 | Bettiol et al. | 510/101 |
| 6,566,312 | B2 | * | 5/2003 | Bettiol et al. | 510/102 |
| 6,699,823 | B2 | * | 3/2004 | Perneel et al. | 510/101 |
| 2001/0011068 | A1 | | 8/2001 | Bird et al. | |

FOREIGN PATENT DOCUMENTS

| | | | |
|---|---|---|---|
| EP | 0 965 326 | A1 | 12/1999 |
| EP | 1 111 034 | A1 | 6/2001 |
| GB | 2 311 296 | A | 9/1997 |
| GB | 2357523 | A | 6/2001 |
| WO | WO 95/04809 | | 2/1995 |
| WO | WO 95/08976 | | 4/1995 |
| WO | WO 95/27036 | | 10/1995 |
| WO | WO 97/34987 | | 9/1997 |
| WO | WO 97/34993 | | 9/1997 |
| WO | WO 99/14245 | | 3/1999 |
| WO | WO 99/55819 | | 11/1999 |
| WO | WO 00/01361 | | 1/2000 |
| WO | WO 00/02981 | | 1/2000 |
| WO | WO 00/02982 | | 1/2000 |
| WO | WO 00/02986 | | 1/2000 |
| WO | WO 00/02987 | | 1/2000 |
| WO | WO 00/02991 | | 1/2000 |
| WO | WO 01/04084 | A1 | 1/2001 |
| WO | WO 01/04247 | A1 | 1/2001 |
| WO | WO 01/04248 | A1 | 1/2001 |
| WO | WO 01/46374 | A1 | 6/2001 |
| WO | WO 01/51599 | A1 | 7/2001 |

* cited by examiner

*Primary Examiner*—John R. Hardee
(74) *Attorney, Agent, or Firm*—James F. McBride; Kim W. Zerby; Steve W. Miller

(57) ABSTRACT

The present invention relates to a solid particulate fabric-treatment composition comprising:

(a) a first perfume component comprising a pro-perfume compound that is the product of a reaction between an amino-functional compound comprising at least one primary and/or secondary amine group and an amine-reactive perfume molecule comprising a ketone and/or an aldehyde functionality; and (b) a second perfume component comprising:
  (i) at least 30% by weight of the second perfume component of volatile perfume molecules having:
    (i) a boiling point of less than 250° C.; and
    (ii) a clogP value of greater than 2; and
    (iii) an odour detection threshold of less than 50 parts per billion; and
  (ii) less than 35% by weight of the second perfume component of non-volatile perfume molecules having:
    (i) a boiling point of greater than 250° C.; and
    (ii) a clogP value of greater than 3; and
    (iii) an odour detection threshold less than 50 parts per billion; and (c) optionally, adjunct detergent components;

wherein, the composition comprises particles that comprise at least 1% by weight of the particle of the first perfume component and less than 1% by weight of the particle of the second perfume component.

18 Claims, No Drawings

FABRIC TREATMENT COMPOSITION

CROSS REFERENCE TO RELATED APPLICATIONS

This application claims priority under 35 U.S.C. § 119(e) to Great Britain Application Serial No. 0128851.3, filed Dec. 3, 2001.

FIELD OF THE INVENTION

The present invention relates to a solid particulate fabric-treatment composition comprising a perfume system.

BACKGROUND TO THE INVENTION

Most consumers assess the performance of a laundry detergent composition not only by the visual appearance of the laundered fabric but also by the smell of the laundered fabric. Thus, a laundry detergent composition, in addition to cleaning fabric, must also provide a pleasing fragrance that is delivered to the laundered fabric during the laundering process. To date, laundry detergent manufacturers incorporate a perfume in their detergent compositions to provide a pleasing fragrance to the treated fabric.

However, the consumers desire that treated fabrics have a pleasing fragrance immediately after the washing stage of the laundering process, as this gives the consumer a signal that their fabric is both clean and fresh. In addition, the consumers desire that the fabric maintains a pleasing fragrance over time.

Detergent manufacturers have developed perfume systems that prolong the pleasing fragrance of laundered fabric. For example, this is described in U.S. Pat. No. 5,188,753, WO95/04809, WO95/08976, WO00/02982, WO00/02986, WO00/02987, WO00/02991, WO01/04084, WO01/04247, WO01/04248, WO01/46374 and WO01/51599. Although these perfume systems prolong the fragrance release from laundered fabric, they do not necessarily provide a highly noticeable fragrance immediately after the washing stage of the laundering process. Thus, these perfume systems do not provide the consumer with a clear signal that their laundry is clean and fresh. Therefore, there remains a need to provide a perfume system that provides both an initial good perfume performance immediately after the washing stage of the laundering process, and a good perfume release from dry-fabric over a prolonged period of time.

SUMMARY OF THE INVENTION

The present invention overcomes the above problems by providing a solid particulate fabric-treatment composition comprising a first perfume component and a second perfume component, and optionally one or more adjunct components. The first perfume component comprises a pro-perfume compound that is the product of a reaction between an amino-functional compound comprising at least one primary and/or secondary amine group and an amine-reactive perfume molecule comprising a ketone and/or an aldehyde functionality. The second perfume component comprises: (i) at least 30% by weight of the second perfume component of volatile perfume molecules having: (i) a boiling point of less than 250° C.; and (ii) a clogP value of greater than 2; and (iii) an odour detection threshold of less than 50 parts per billion; and (ii) less than 35% by weight of the second perfume component of non-volatile perfume molecules having: (i) a boiling point of greater than 250° C.; and (ii) a clogP value of greater than 3; and (iii) an odour detection threshold less than 50 parts per billion. The composition can optionally comprise various adjunct components, preferably detergent adjunct components. The composition must comprise particles that comprise at least 1% by weight of the particle of the first perfume component and less than 1% by weight of the particle of the second perfume component.

In a further aspect of the present invention, there is provided a process for making the above composition. In a further aspect of the present invention, there is provided a method of treating fabric by contacting fabric with the above composition in an aqueous environment. In a further aspect of the present invention, there is provided a use of the above composition for treating fabric in an aqueous environment.

DETAILED DESCRIPTION OF THE INVENTION

First Perfume Component

The first perfume component comprises a pro-perfume compound that is the product of a reaction between an amino-functional compound, preferably a polymer, comprising at least one primary and/or secondary amine group and an amine-reactive perfume molecule comprising a ketone and/or an aldehyde functionality. The first perfume component provides improved dry-fabric odour benefits as the pro-perfume degrades.

Typically, the amino-functional compound has an Odour Intensity Index (OII) of less than that of a 1% solution of methylanthranilate in dipropylene glycol. By OII, it is meant that the pure chemicals were diluted at 1% in dipropylene glycol, which is an odour-free solvent used in perfumery. Smelling strips, also known as blotters, are dipped and presented to an expert panellist for evaluation. For each amino-functional compound, the expert panellist is presented with two blotters: a reference blotter (methylanthranilate) and a sample blotter. The panellist is asked to determine the OII for both blotters using an OII scale of 0–5, 0 indicating that definitely no odour is detected, 1 indicating that odour may be detected, 2 indicating that a weak odour is detected, 3 indicating that odour is detected, 4 indicating that a strong odour is detected, and 5 indicating that a very strong odour is detected. Amino-functional compounds having an odour intensity index less than that of a 1% solution of methylanthranilate in dipropylene glycol are typically suitable for use in the present invention.

The amino-functional compound is typically a polymer that comprises at least one free, unmodified primary and/or secondary amino group that is attached to the polymer backbone or present on a polymer side chain. Preferably, the amino-functional compound will comprise several amino groups, more preferably more than 10 amino groups. The amino-functional compound is typically polymeric, and preferably has a weight average molecular weight (MW) of from 1,500 to 2,100,000, more preferably from 1,800 to 50,000, most preferably from 2,000 to 40,000. Preferred amino-functional polymers can be linear, branched, grafted or cross-linked, and can be a homo-polymer or a co-polymer.

Preferred amino-functional compounds are polymers that are selected from the group consisting of: polyvinylamines; alkylene polyamines; polyaminoacids; amino substituted polyvinylalcohols; polyoxyethylenes; derivatives thereof; and combinations thereof. The term "derivatives thereof" includes co-polymers thereof, branched variants thereof and alkoxylated variants thereof.

Preferred amino-functional compounds are polyethyleneimines such as those sold under the tradename Lupasol, for example, Lupasol FG, G20, wfv, PR8515, WF, FC, G20, G35, G100, HF, P, PS, SK and SNA.

Furthermore, preferred amino-functional compounds, especially when they are polymeric, provide fabric appearance benefits, in particular colour care benefits and protection against fabric wear, especially after multi-wash cycles. Therefore, the composition can simultaneously provide perfume benefits and fabric care benefits.

The amine-reactive perfume molecule comprises a ketone and/or aldehyde functionality. The amine-reactive perfume molecule typically comprises at least 1 carbon atom, preferably at least 5 carbon atoms. A typical disclosure of suitable ketone and/or aldehydes molecules, traditionally used in perfumery, can be found in "perfume and Flavor Chemicals", Vol. I and II, S. Arctander, Allured Publishing, 1994, ISBN 0-931710-35-5.

Preferred amine-reactive perfume molecules comprising a ketone functionality are selected from the group consisting of: Alpha Damascone, Delta Damascone, Iso Damascone, Carvone, Gamma-Methyl-lonone, Iso-E-Super, 2,4,4,7-Tetramethyl-oct-6-en-3-one, Benzyl Acetone, Beta Damascone, Damascenone, methyl dihydrojasmonate, methyl cedrylone, and mixtures thereof.

Preferred amine-reactive perfume molecules comprising an aldehyde functionality are selected from the group consisting of: 1-decanal, benzaldehyde, florhydral, 2,4-dimethyl-3-cyclohexen-1-carboxaldehyde; cis/trans-3,7-dimethyl-2,6-octadien-1-al; heliotropin; 2,4,6-trimethyl-3-cyclohexene-1-carboxaldehyde; 2,6-nonadienal; alpha-n-amyl cinnamic aldehyde, alpha-n-hexyl cinnamic aldehyde, P.T. bucinal, lyral, cymal, methyl nonyl acetaldehyde, hexanal, trans-2-hexenal, and mixtures thereof.

Typically, the amine-reactive perfume molecule has a low Odour Detection Threshold (ODT). Preferably, the amine-reactive perfume molecule has an ODT less than 1 ppm, preferably less than 10 ppb. The ODT is typically measured at controlled Gas Chromatography (GC) conditions such as described here below. This parameter refers to the value commonly used in the perfumery arts and is the lowest concentration at which significant detection takes place that some odorous material is present. Please refer, for example, to "Compilation of Odour and Taste Threshold Value Data (ASTM DS 48 A)", edited by F. A. Fazzalari, International Business Machines, Hopwell Junction, N.Y.

The pro-perfume compound is a product of a reaction between the amino-functional compound and the amine-reactive perfume molecule. Most preferred pro-perfume compounds are the products of a reaction between polyethyleneimine with Alpha and/or Delta Damascone.

Typically, the pro-perfume compound has a Dry Surface Odour Index (DSOI) of more than 5, preferably more than 10, or even more than 20. The DSOI is determined by the following test:

0.04 g of the pro-perfume compound is added to 100 g of a granular detergent composition comprising (parts by weight of the composition) 9 parts sodium dodecylbenzene sulphonate, 4 parts $C_{14-15}$ ethoxylated alcohol having an average of 7 ethoxylate groups per alcohol molecule, 33 parts of sodium tripolyphosphate, 6 parts of alkaline sodium silicate, 1 part sodium carboxymethyl cellulose, 1 part magnesium silicate, 0.2 parts ethylenediamine tetraacetic acid, 25 parts sodium sulphate, and 10.8 parts water. Four pieces of dry fabric having a total dry weight of 170 g were loaded into the drum of an automatic washing machine. The detergent composition (plus pro-perfume compound that was added thereto) is dispensed into the drum of the automatic washing machine, and the fabric is then washed using a 40° C. wash cycle designed for coloured synthetic fabrics and using water having a Hardness of 15° and an inlet temperature of 10–18° C.

Immediately after the end of the washing cycle, the damp fabrics are placed in a tumble drier and undergo a full drying cycle. The next day, the tumble dry fabrics are assessed for their odour using the scale described below. The fabrics are then stored in opened aluminium bags in a substantially odour-free room, and their odour is assessed again after 7 days. The above method is repeated for the equivalent amine-reactive perfume molecule, using the same molar amount used for the perfume compound.

The odour provided by both the pro-perfume compound and equivalent amine-reactive perfume molecule are assessed by expert panellists smelling the fabrics and using the following grading scale of 0–100 for all of the above fabric odour grading. The grading scale is as follows: 100=extremely strong perfume odour, 75=very strong perfume odour, 50=strong odour, 40=moderate perfume odour, 30=slight perfume odour, 20=weak perfume odour, 10=very weak perfume odour, 0=no odour.

The DSOI can be calculated by subtracting the odour measurement for the equivalent amine-reactive perfume molecule from the odour measurement for the pro-perfume compound that was determined after 1 day and 7 day, respectively. Pro-perfume compounds that have a DSOI of more than 5 using either the measurements taken after 1 day or after 7 days, respectively, are typically suitable for use in the present invention.

Typical pro-perfume compounds, amino-functional compounds and amine-reactive perfume molecules that are suitable for use herein, and preferred methods for synthesising the pro-perfume compound are described in EP1123376.

Second Perfume Component

The second perfume component comprises (by weight of the second perfume component) at least 20%, preferably at least 30%, or even at least 40%, of volatile perfume molecules and less than 35%, preferably less than 30%, more preferably less than 20%, or even less than 10% of non-volatile perfume molecules. The second perfume component provides good initial perfume performance, such as good damp-fabric perfume odour release.

The volatile perfume molecules have a boiling point of less than 250° C., preferably less than 220° C., even preferably less than 200° C. The boiling points of many perfume ingredients are given in: "Perfume and Flavor Chemicals (Aroma Chemicals)," Steffen Arctander, published by the author, 1969.

The volatile perfume molecules have a clogP value of greater than 2, preferably greater than 3, more preferably greater than 4, or even greater than 5. The clog P value is a measurement of the octanol/water partition coefficient of the perfume molecule and is the ratio between its equilibrium concentrations in octanol and in water. Since the partition coefficients of the preferred perfume ingredients of this invention have high values, they are more conveniently given in the form of their logarithm to the base 10, logP, which is known as the clogP value.

The clogP value of many perfume ingredients has been reported; for example, the Pomona92 database, available from Daylight Chemical Information Systems, Inc. (Daylight CIS), Irvine, Calif., contains many, along with citations to the original literature. However, the clogP values can also be calculated by the "CLOGP" program, available from Daylight CIS. The "clogP value" is typically determined by the fragment approach of Hansch and Leo: c.f. A. Leo, in Comprehensive Medicinal Chemistry, Vol. 4, C. Hansch, P. G. Sammens, J. B. Taylor and C. A. Ramsden, Eds., p. 295, Pergamon Press, 1990.

The volatile perfume molecules have an Odour Detection Threshold (ODT) of less than 50 parts per billion (ppb), preferably less than 10 ppb. The ODT is described above in more detail.

Preferred volatile perfume molecules are selected from the group consisting of: ethyl 2 methyl butyrate, 4 acetate flor acetate, linalool, ethyl 2 methyl pentanoate, tetra hydro linalool, cis 3 hexenyl acetate, cis 3 hexanol, cyclal C, and mixtures thereof.

The non-volatile perfume molecules have a boiling point of greater than 250° C., preferably greater than 260° C., or even greater than 275° C. The non-volatile perfume molecules have a clogP value of greater than 3, preferably greater than 4, or even greater than 5, and have an Odour Detection Threshold (ODT) of less than 50 parts per billion (ppb), preferably less than 10 ppb. The clogP value and ODT are described above in more detail.

Preferred non-volatile perfume molecules are selected from the group consisting of: ambroxan, iso-E-super, hexyl cennamic aldehyde, pt bucinal, cetalox, hexyl salicyclate, amberlyn, and mixtures thereof.

Typically, the weight ratio of volatile perfume molecules to non-volatile perfume molecules is greater than 0.7, preferably greater than 1.

Adjunct Components

The composition optionally comprises one or more adjunct components. Typically, the composition comprises from 0.01% to 99.99% adjunct components. Preferred adjunct components are detergent adjunct components, preferably laundry detergent adjunct components. Preferred adjunct components are selected from the group consisting of: anti-redeposition agents, bleaching agents, brighteners, builders, chelants, dye-transfer inhibitors, enzymes, fabric-integrity agents, fabric-softening agents, fillers, flocculants, perfumes, soil release agents, surfactants, soil-suspension agents, and combinations thereof.

A highly preferred adjunct component is a surfactant. Preferably, the composition comprises one or more surfactants. Typically, the composition comprises (by weight of the composition) from 0% to 50%, preferably from 5% and preferably to 40%, or to 30%, or to 20% one or more surfactants. Preferred surfactants are anionic surfactants, non-ionic surfactants, cationic surfactants, zwitterionic surfactants, amphoteric surfactants, catanionic surfactants and mixtures thereof.

Preferred anionic surfactants comprise one or more moieties selected from the group consisting of carbonate, phosphate, sulphate, sulphonate and mixtures thereof. Preferred anionic surfactants are $C_{8-18}$ alkyl sulphates and $C_{8-18}$ alkyl sulphonates. The $C_{8-18}$ alkyl sulphates and/or $C_{8-18}$ alkyl sulphonates may optionally be condensed with from 1 to 9 moles of $C_{1-4}$ alkylene oxide per mole of $C_{8-18}$ alkyl sulphate and/or $C_{8-18}$ alkyl sulphonate. The alkyl chain of the $C_{8-18}$ alkyl sulphates and/or $C_{8-18}$ alkyl sulphonates may be linear or branched, preferred branched alkyl chains comprise one or more branched moieties that are $C_{1-6}$ alkyl groups. Other preferred anionic surfactants are $C_{8-18}$ alkyl benzene sulphates and/or $C_{8-18}$ alkyl benzene sulphonates. The alkyl chain of the $C_{8-18}$ alkyl benzene sulphates and/or $C_{8-18}$ alkyl benzene sulphonates may be linear or branched, preferred branched alkyl chains comprise one or more branched moieties that are $C_{1-6}$ alkyl groups. Other preferred anionic surfactants are selected from the group consisting of: $C_{8-18}$ alkenyl sulphates, $C_{8-18}$ alkenyl sulphonates, $C_{8-18}$ alkenyl benzene sulphates, $C_{8-18}$ alkenyl benzene sulphonates, $C_{8-18}$ alkyl di-methyl benzene sulphate, $C_{8-18}$ alkyl di-methyl benzene sulphonate, fatty acid ester sulphonates, di-alkyl sulphosuccinates, and combinations thereof. The anionic surfactants may be present in the salt form. For example, the anionic surfactant may be an alkali metal salt of one or more of the compounds selected from the group consisting of: $C_{8-18}$ alkyl sulphate, $C_{8-18}$ alkyl sulphonate, $C_{8-18}$ alkyl benzene sulphate, $C_8$-$C_{18}$ alkyl benzene sulphonate, and combinations thereof. Preferred alkali metals are sodium, potassium and mixtures thereof. Typically, the composition comprises from 0% to 50% anionic surfactant.

Preferred non-ionic surfactants are selected from the group consisting of: $C_{8-18}$ alcohols condensed with from 1 to 9 of $C_1$-$C_4$ alkylene oxide per mole of $C_{8-18}$ alcohol, $C_{8-18}$ alkyl N-$C_{1-4}$ alkyl glucamides, $C_{8-18}$ amido $C_{1-4}$ dimethyl amines, $C_{8-18}$ alkyl polyglycosides, glycerol monoethers, polyhydroxyamides, and combinations thereof.

Preferred cationic surfactants are quaternary ammonium compounds. Preferred quaternary ammonium compounds comprise a mixture of long and short hydrocarbon chains, typically alkyl and/or hydroxyalkyl and/or alkoxylated alkyl chains. Typically, long hydrocarbon chains are $C_{8-18}$ alkyl chains and/or $C_{8-18}$ hydroxyalkyl chains and/or $C_{8-18}$ alkoxylated alkyl chains. Typically, short hydrocarbon chains are $C_{1-4}$ alky chains and/or $C_{1-4}$ hydroxyalkyl chains and/or $C_{1-4}$ alkoxylated alkyl chains. Typically, the composition comprises (by weight of the composition) from 0% to 20% cationic surfactant.

Preferred zwitterionic surfactants comprise one or more quaternized nitrogen atoms and one or more moieties selected from the group consisting of: carbonate, phosphate, sulphate, sulphonate, and combinations thereof. Preferred zwitterionic surfactants are alkyl betaines. Other preferred zwitterionic surfactants are alkyl amine oxides.

Typically, catanionic surfactants are complexes comprising a cationic surfactant and an anionic surfactant. Typically, the molar ratio of the cationic surfactant to anionic surfactant in the complex is greater than 1:1, so that the complex has a net positive charge.

A preferred adjunct component is a builder. Preferably, the composition comprises (by weight of the composition and on an anhydrous basis) from 5% to 50% builder. Preferred builders are selected from the group consisting of: inorganic phosphates and salts thereof, preferably orthophosphate, pyrophosphate, tri-poly-phosphate, alkali metal salts thereof, and combinations thereof; polycarboxylic acids and salts thereof, preferably citric acid, alkali metal salts of thereof, and combinations thereof; aluminosilicates, salts thereof, and combinations thereof, preferably amorphous aluminosilicates, crystalline aluminosilicates, mixed amorphous/crystalline aluminosilicates, alkali metal salts thereof, and combinations thereof, most preferably zeolite A, zeolite P, zeolite MAP, salts thereof, and combinations thereof; layered silicates, salts thereof, and combinations thereof, preferably sodium layered silicate; and combinations thereof.

A preferred adjunct component is a bleaching agent. Preferably, the composition comprises one or more bleaching agents. Typically, the composition comprises (by weight of the composition) from 1% to 50% of one or more bleaching agent. Preferred bleaching agents are selected from the group consisting of sources of peroxide, sources of peracid, bleach boosters, bleach catalysts, photo-bleaches, and combinations thereof. Preferred sources of peroxide are selected from the group consisting of: perborate monohydrate, perborate tetra-hydrate, percarbonate, salts thereof, and combinations thereof. Preferred sources of peracid are selected from the group consisting of: bleach activators, preformed peracids, and combinations thereof. Preferred bleach activators are selected from the group consisting of: oxy-benzene-sulphonate bleach activators, lactam bleach activators, imide bleach activators, and combinations thereof. A preferred source of peracid is tetra-acetyl ethylene diamine (TAED). Preferred oxy-benzene-sulphonate bleach activators are selected from the group consisting of: nonanoyl-oxy-benzene-sulponate, 6-nonamido-caproyl-oxy-benzene-sulphonate, salts thereof, and combinations thereof. Preferred lactam bleach activators are acyl-caprolactams and/or acyl-valerolactams. A preferred imide bleach activator is N-nonanoyl-N-methyl-acetamide. Preferred preformed peracids are selected from the group consisting of N,N-pthaloyl-amino-peroxycaproic acid, nonyl-amido-peroxyadipic acid, salts thereof, and combinations thereof. Preferably, the composition comprises one or more sources of peroxide and one or more sources of peracid. Preferred bleach catalysts comprise one or more transition metal ions. Other preferred bleaching agents are di-acyl peroxides. Preferred bleach boosters are selected from the group consisting of: zwitterionic imines, anionic imine polyions, quaternary oxaziridinium salts, and combinations thereof. Highly preferred bleach boosters are selected from the group consisting of: aryliminium zwitterions, aryliminium polyions, and combinations thereof. Suitable bleach boosters are described in U.S. Pat. No. 360,568, U.S. Pat. No. 5,360,569 and U.S. Pat. No. 5,370,826.

A preferred adjunct component is an anti-redeposition agent. Preferably, the composition comprises one or more anti-redeposition agents. Preferred anti-redeposition agents are cellulosic polymeric components, most preferably carboxymethyl celluloses.

A preferred adjunct component is a chelant. Preferably, the composition comprises one or more chelants. Preferably, the composition comprises (by weight of the composition) from 0.01% to 10% chelant. Preferred chelants are selected from the group consisting of: hydroxyethane-dimethylene-phosphonic acid, ethylene diamine tetra(methylene phosphonic) acid, diethylene triamine pentacetate, ethylene diamine tetraacetate, diethylene triamine penta(methyl phosphonic) acid, ethylene diamine disuccinic acid, and combinations thereof.

A preferred adjunct component is a dye transfer inhibitor. Preferably, the composition comprises one or more dye transfer inhibitors. Typically, dye transfer inhibitors are polymeric components that trap dye molecules and retain the dye molecules by suspending them in the wash liquor. Preferred dye transfer inhibitors are selected from the group consisting of: polyvinylpyrrolidones, polyvinylpyridine N-oxides, polyvinylpyrrolidone-polyvinylimidazole copolymers, and combinations thereof.

A preferred adjunct component is an enzyme. Preferably, the composition comprises one or more enzymes. Preferred enzymes are selected from then group consisting of: amylases, arabinosidases, carbohydrases, cellulases, chondroitinases, cutinases, dextranases, esterases, β-glucanases, gluco-amylases, hyaluronidases, keratanases, laccases, ligninases, lipases, lipoxygenases, malanases, mannanases, oxidases, pectinases, pentosanases, peroxidases, phenoloxidases, phospholipases, proteases, pullulanases, reductases, tannases, transferases, xylanases, xyloglucanases, and combinations thereof. Preferred enzymes are selected from the group consisting of: amylases, carbohydrases, cellulases, lipases, proteases, and combinations thereof.

A preferred adjunct component is a fabric integrity agent. Preferably, the composition comprises one or more fabric integrity agents. Typically, fabric integrity agents are polymeric components that deposit on the fabric surface and prevent fabric damage during the laundering process. Preferred fabric integrity agents are hydrophobically modified celluloses. These hydrophobically modified celluloses reduce fabric abrasion, enhance fibre-fibre interactions and reduce dye loss from the fabric. A preferred hydrophobically modified cellulose is described in WO99/14245. Other preferred fabric integrity agents are polymeric components and/or oligomeric components that are obtainable, preferably obtained, by a process comprising the step of condensing imidazole and epichlorhydrin.

A preferred adjunct component is a fabric-softening agent. Preferably the composition comprises (by weight of the composition) from 0.1% to 20%, preferably from 1% to 10% a fabric-softening agent. Preferred fabric softening agents are clays and/or quaternary ammonium compounds. Typically, the clay is selected from the group consisting of: allophane clays; illite clays; kaolin clays, preferred kaolin clays are kaolinite clays; smectite clays; and mixtures thereof. Preferably, the clay is a smectite clay. Preferred smectite clays are beidellite clays, hectorite clays, laponite clays, montmorillonite clays, nontonite clays, saponite clays and mixtures thereof. Preferably, the smectite clay may be a dioctahedral smectite clay. A preferred dioctahedral smectite clay is montmorillonite clay. The montmorillonite clay may be low-charge montmorillonite clay (also known as sodium montmorillonite clay or Wyoming-type montmorillonite clay) or a high-charge montmorillonite clay (also known as a calcium montmorillonite clay or Cheto-type montmorillonite clay). The smectite clay may also be a trioctahedral smectite clay. Preferred trioctahedral smectite clays are hectorite clays. Especially preferred Hectorite clays are supplied by Rheox, and sold under the tradenames "Hectorite U" and "Hectorite R". The clay may be a light coloured crystalline clay mineral, preferably having a reflectance of at least 60, more preferably at least 80 at a wavelength of 460 nm. Typically, the average particle size of the light coloured crystalline clay mineral particles should not exceed 2 μm, especially preferably not exceeding 1 μm. The average particle size of the light coloured crystalline clay mineral particles is typically measured using a Malvern Zetasizer™, using a dispersion of the light coloured crystalline clay at 0.1 g/l in deionised water, the clay being dispersed by vigorous agitation for 1 minute. Preferred light coloured crystalline clay minerals are described in GB2357523A and WO01/44425.

A preferred adjunct component is a flocculant. Preferably, the composition comprises (by weight of the composition) from 0.01% to 25%, preferably from 0.5%, and preferably to 20%, or to 15%, or to 10%, or to 5% one or more flocculants. Preferred flocculants are polymeric components, typically having a weight average molecular weight of at least 100 kDa, preferably at least 200 kDa. Preferred flocculants are polymeric components derived from monomeric units selected from the group consisting of: ethylene oxide, acrylamide, acrylic acid, dimethylamino ethyl methacrylate, vinyl alcohol, vinyl pyrrolidone, ethylene imine, and combinations thereof. Other preferred flocculants are gums, especially guar gums. A highly preferred flocculant is polyethylene oxide, preferably having a weight average molecular weight of at least 100 kDa, preferably at least 200 kDa. Preferred flocculants are described in WO95/27036.

A preferred adjunct component is a salt. Preferably, the composition comprises one or more salts. The salts can act as alkalinity agents, buffers, builders, co-builders, encrustation inhibitors, fillers, pH regulators, stability agents, and combinations thereof. Typically, the composition comprises (by weight of the composition) from 5% to 60% salt. Preferred salts are alkali metal salts of aluminate, carbonate, chloride, bicarbonate, nitrate, phosphate, silicate, sulphate, and combinations thereof. Other preferred salts are alkaline earth metal salts of aluminate, carbonate, chloride, bicarbonate, nitrate, phosphate, silicate, sulphate, and combinations thereof. Especially preferred salts are sodium sulphate, sodium carbonate, sodium bicarbonate, sodium silicate, sodium sulphate, and combinations thereof. Optionally, the alkali metal salts and/or alkaline earth metal salts may be anhydrous.

A preferred adjunct component is a soil release agent. Preferably, the composition comprises one or more soil release agents. Typically, soil release agents are polymeric compounds that modify the fabric surface and prevent the redeposition of soil on the fabric. Preferred soil release agents are copolymers, preferably block copolymers, comprising one or more terephthalate unit. Preferred soil release agents are copolymers that are synthesised from dimethylterephthalate, 1,2-propyl glycol and methyl capped polyethyleneglycol. Other preferred soil release agents are anionically end capped polyesters.

A preferred adjunct component is a soil suspension agent. Preferably, the composition comprises one or more soil suspension agents. Preferred soil suspension agents are polymeric polycarboxylates. Especially preferred are polymers derived from acrylic acid, polymers derived from maleic acid, and co-polymers derived from maleic acid and acrylic acid. In addition to their soil suspension properties, polymeric polycarboxylates are also useful co-builders for laundry detergents. Other preferred soil suspension agents are alkoxylated polyalkylene imines. Especially preferred alkoxylated polyalkylene imines are ethoxylated polyethylene imines, or ethoxylated-propoxylated polyethylene imine. Other preferred soil suspension agents are represented by the formula:

$$\text{bis}((C_2H_5O)(C_2H_4O)_n(CH_3)\text{—}N^+\text{—}C_xH_{2x}\text{—}N^+\text{—}(CH_3)\text{-}\text{bis}((C_2H_4O)_n(C_2H_5O)),$$

wherein, n=from 10 to 50 and x=from 1 to 20. Optionally, the soil suspension agents represented by the above formula can be sulphated and/or sulphonated.

Composition

The fabric treatment composition can be a perfume additive composition or a laundry detergent composition. The composition can comprise agglomerated particles, extruded particles, marumerised particles, flakes, and mixtures thereof. Typically, the composition is not in the form of a tablet. However, if the composition is in the form of a tablet, then preferably the composition is obtainable by a process comprising the steps of: (a) obtaining a composition that is in the form of a tablet, and which comprises the first perfume component; and (b) subsequent to step (a), contacting the second perfume component to the composition obtained in step (a).

Typically, the perfume additive composition is suitable for use in a laundering process where a laundry detergent composition is also used. The perfume additive composition can be added to the fabric during the pre-washing stage, washing stage and/or rinsing stage. Preferably, the fabric-treatment composition is a solid particulate laundry detergent composition. The composition is suitable for use in a laundering process, and typically is contacted to fabric in an aqueous environment, where it provides perfume benefits and fabric-treatment benefits.

It is preferred to keep the first perfume component and second perfume component separated within the composition, in order to achieve both good damp fabric perfume odour release and prolonged good dry fabric perfume odour release. Therefore, the composition comprises particles that comprise (by weight of the particle) at least 1%, preferably at least 2% or even at least 3% of the first perfume component, and less than 1%, preferably less than 0.5% or even less than 0.1% of the second perfume component.

Process for Making the Composition

The composition is typically obtainable, preferably obtained, by a process comprising the steps of: (a) obtaining a plurality of particles comprising the first perfume component; and (b) combining the particles obtained in step (a) with a plurality of particles comprising an adjunct component; and (c) contacting the second perfume component with the mixture of particles obtained in step (b) to obtain a solid particulate composition. Typically, the second perfume component in step (c) is in the form of a liquid, preferably during step (c) the second perfume component is sprayed onto the mixture of particles obtained in step (b). Typically, the first perfume component is in the form of a particle, typically an agglomerate, and is mixed with other particles, typically spray-dried particles and/or agglomerates comprising adjunct components. If the composition is a laundry detergent composition, then, typically, the mixture of particles obtained in step (b) above, is the base powder of the detergent.

EXAMPLES

Example I

Synthesis of Lupasol with Damascone and 2,4-dimethyl-3-cyclohexen-1-carboxaldehyde Lupasol G100 is dried using the following procedure: 20 g of Lupasol solution is dried using a rotating evaporator for several hours. The obtained material is azeotropically distilled at the rotating evaporator using toluene. The material is then placed in a desiccator and dried at 60° C., using $P_2O_5$ as a water absorbing material.

1.38 g of the dried Lupasol material is dissolved in 7 ml ethanol, the solution is gently stirred for a few minutes and 2 g anhydrous $NaSO_4$ is added to the solution. The solution is further stirred and 2.21 g α-Damascone is added to the solution over a period of 1 minute. The reaction is left for two days. After two days, the reaction mixture is filtrated over a Celite filter and the residue is washed thoroughly with ethanol. About 180 g of filtrate is obtained. This filtrate is concentrated and dried using a rotating evaporator and dried over $P_2O_5$ in a desiccator at room temperature. Similar materials are obtained using Lupasol G35 or Lupasol HF instead of Lupasol G100. Similar materials are also obtained using 2,4-dimehtyl-3-cyclohexen-1-carboxaldehyde instead of using α-Damascone.

Example II

Pro-Perfume Particles

Pro-perfume particles are obtained by mixing 20 g of the material obtained in example I with 80 g TAE80 for 5 minutes at 70° C., which is substantially the melting point of the mixture. The mixture is then poured into a mixer comprising 200 g carbonate and mixed for 5 minutes at a temperature that does not exceed 65° C., to obtain pro-perfume particles.

Example III

Perfume Liquids

The following compositions are liquid perfume compositions. The amounts of ingredients given below are expressed in terms of % by weight of the liquid perfume composition, and the boiling points given are expressed in terms of ° C.

| Ingredient | Amount | Boiling Point | clogP value |
|---|---|---|---|
| Liquid perfume composition A | | | |
| Ethyl-2-methyl pentanoate | 2 | 159 | 2.7 |
| Ethyl-2-methyl butyrate | 1 | 131 | 2.1 |
| 2,4,dimethyl-3-cyclohexene-1-carbaldehyde | 6 | 208 | 2.4 |
| Tricyclo decenyl acetate | 15 | 245 | 2.4 |
| Orthotertiary butyl cyclohexyl acetate | 25 | 237 | 4.1 |
| Phenyl ethyl alcohol | 25 | 222 | 1.2 |
| Naphtho [2,1-b] furan-dodecahydro-3a,6,6,9a tetramethyl | 1 | 280 | 5.3 |
| 7-acetyl,1,2,3,4,5,6,7,8-octahydro-1,1,6,7, tetramethyl naphthalene | 15 | 306 | 4.8 |
| 2-methyl 3-[4-tert-butyl phenyl]-propanal | 10 | 287 | 3.9 |
| Liquid perfume composition B | | | |
| Tricyclo decenyl acetate | 10 | 245 | 2.4 |
| Methyl isobutenyl tetrahydro pyran | 2 | 198 | 2.9 |
| 4-methoxy benzaldehyde | 4 | 220 | 1.8 |
| 3,7, dimethyl-1,6-octadien-3-ol | 15 | 205 | 2.5 |
| Phenyl ethyl alcohol | 16 | 222 | 1.2 |
| 4-phenyl butan-2-one | 10 | 235 | 1.7 |
| Phenyl methyl ethanoate | 16 | 211 | 2.0 |
| 2-ethyl-4-(2,2,3-trimethyl-3-cyclopenten-1-yl)-2-butene-1-ol | 2 | 298 | 4.4 |
| 7-acetyl,1,2,3,4,5,6,7,8-octahydro-1,1,6,7, tetramethyl naphthalene | 10 | 306 | 4.8 |
| 3-buten-2-one, 4-(2,6,6-trimethyl-1-cyclohexenyl) | 15 | 276 | 3.8 |

Example IV

Detergent Compositions 0.6 g of the pro-perfume particles of example II are dry added to 100 g of any of detergent base powders A–G described below, respectively. 0.6 g of any of the liquid perfume compositions from example III are then sprayed onto the base powder (which are already mixed with the perfume particles of example II) to form solid particulate detergent compositions.

What is claimed is:

1. A solid particulate fabric-treatment composition comprising:

(a) a first perfume component comprising a pro-perfume compound that is the product of a reaction between an amino-functional compound comprising at least one primary and/or secondary amine group and an amine-reactive perfume molecule comprising a ketone and/or an aldehyde functionality; and (b) a second perfume component comprising:

(i) at least 20% by weight of the second perfume component of volatile perfume molecules having:

(i) a boiling point of less than 250° C.; and (ii) a clogP value of greater than 2; and (iii) an odour detection threshold of less than 50 parts per billion; and (ii) less than 35% by weight of the second perfume component of non-volatile perfume molecules having:

i) a boiling point of greater than 250° C.; and (ii) a clogP value of greater than 3; and (iii) an odour detection threshold of less than 50 parts per billion; and (c) optionally, adjunct detergent components;

wherein, the composition comprises particles that comprise at least 1% by weight of the particle of the first perfume component, and from 0.1% to less than 1% by weight of the particle of the second perfume component.

2. A composition according to claim 1, wherein the amino-functional compound has an odour intensity index of less than that of a 1% solution of methylanthranilate in dipropyl glycol.

3. A composition according to claim 1, wherein the pro-perfume compound has a dry surface odour index of more than 5.

4. A composition according to claim 1, wherein the amino-functional compound is a polymer selected from the group consisting of: polyvinylamines; alkylene polyamines; polyaminoacids; amino-substituted polyvinylalcohols; polyoxyethylenes; derivatives thereof; and combinations thereof.

5. A composition according to claim 1, wherein the second perfume component comprises at least 30% by weight of the second perfume component of volatile perfume molecules.

| Ingredient | A | B | C | D | E | F | G |
|---|---|---|---|---|---|---|---|
| Smectite clay | 6% | | 4% | 7% | 10% | | |
| Polyethylene oxide flocculant | | 0.1% | 0.2% | 0.2% | 0.1% | | |
| Anionic surfactant | 5% | 15% | 7% | 6% | 6.5% | 7% | 8% |
| Cationic surfactant | 2% | | 0.5% | 1.5% | 3% | 1% | 1.5% |
| Nonionic surfactant | 1% | 2% | | | | 5% | |
| Zeolite A | 19% | 20% | 28% | 17% | 19% | 18% | 31% |
| Crystalline layered silicate | 4% | 3% | 3% | 2% | 4% | 3% | 4% |
| Anhydrous sodium carbonate | 25% | 20% | 22% | 23% | 25% | 22% | 25% |
| Anhydrous sodium sulphate | 25% | 25% | 17% | 28% | 17% | 32% | 17% |
| Acrylic/maleic copolymer | 1% | 2% | 2% | 1.5% | 1% | 1.5% | 1% |
| Sodium perborate tetrahydrate | 8% | 6% | 10% | | | | 5% |
| Sodium percarbonate | | | | 6% | 7% | 5% | |
| Tetraacetate ethylene diamine | 1% | 1.2% | 0.8% | 1% | 1.1% | 1% | 0.9% |
| Hydrophobically modified cellulose | 0.7% | 0.5% | 1% | 1.5% | | | 0.8% |
| Enzymes | 0.3% | 0.5% | 0.4% | 0.5% | 0.4% | 0.3% | 0.3% |
| Miscellaneous | to 100% | to 100% | to 100% | to 100% | to 100% | to 100% | to 100% |

6. A composition according to claim 1, wherein the weight ratio of volatile perfume molecules to non-volatile perfume molecules is greater than 0.7.

7. A composition according to claim 1, wherein the composition comprises clay.

8. A composition according to claim 1, wherein the composition is obtainable by a process comprising the steps of:

(a) obtaining a plurality of particles comprising the first perfume component; and (b) combining the particles obtained in step (a) with a plurality of particles comprising an adjunct component; to obtain a mixture of particles; and (c) contacting the second perfume component with the mixture of particles obtained in step (b) to obtain a solid particulate composition.

9. A composition according to claim 8, wherein the second perfume component in step (c) is in the form of a liquid.

10. A composition according to claim 1, wherein the adjunct component is a detergent adjunct component.

11. A composition according to claim 1, wherein the composition is in the form of a tablet, and wherein the composition is obtainable by a process comprising the steps of:

(a) obtaining a composition that is in the form of a tablet, and which comprises the first perfume component; and (b) subsequent to step (a), contacting the second perfume component to the composition obtained in step (a).

12. A process for making a solid particulate detergent composition according to claim 1, the process comprises the steps of:

(a) obtaining a plurality of particles comprising the first perfume component; and (b) combining the particles obtained in step (a) with a plurality of particles comprising an adjunct component; and (c) contacting the second perfume component to the mixture of particles obtained in step (b) to obtain a solid particulate composition.

13. A process according to claim 12, wherein the second perfume component in step (c) is in the form of a liquid, and wherein preferably during step (c) the second perfume component is sprayed onto the mixture of particles obtained in step (b).

14. A method of treating fabric comprising the step of contacting fabric with a composition according to claim 1 in an aqueous environment.

15. A composition according to claim 6, wherein the weight ratio of volatile perfume molecules to non-volatile perfume molecules is greater than 1.

16. A composition according to claim 7, wherein said clay comprises smectite clay.

17. A composition according to claim 8, wherein the second perfume component is sprayed onto the mixture of particles obtained in step (b).

18. A composition according to claim 10, said composition being a laundry detergent composition that comprises a laundry detergent adjunct component.

* * * * *

UNITED STATES PATENT AND TRADEMARK OFFICE

CERTIFICATE OF CORRECTION

PATENT NO. : 6,916,769 B2
DATED : July 12, 2005
INVENTOR(S) : McRitchie et al.

It is certified that error appears in the above-identified patent and that said Letters Patent is hereby corrected as shown below:

Title page,
Insert Item -- [30] Foreign Application Priority Data
December 3, 2001 (GB)……...0128851.3 --.

Signed and Sealed this

Fourteenth Day of March, 2006

JON W. DUDAS
*Director of the United States Patent and Trademark Office*